US010907295B2

(12) United States Patent
Boutiette

(10) Patent No.: US 10,907,295 B2
(45) **Date of Patent: *Feb. 2, 2021**

(54) WASHING MACHINE APPLIANCE AND NOZZLE ASSEMBLY

(71) Applicant: Haier US Appliance Solutions, Inc., Wilmington, DE (US)

(72) Inventor: Todd Boutiette, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 231 days.

This patent is subject to a terminal disclaimer.

(21) Appl. No.: 15/980,832

(22) Filed: May 16, 2018

(65) Prior Publication Data

US 2019/0352836 A1 Nov. 21, 2019

(51) Int. Cl.
*D06F 39/08* (2006.01)

(52) U.S. Cl.
CPC ..... *D06F 39/088* (2013.01); *D06F 2202/08* (2013.01)

(58) Field of Classification Search
CPC .... D06F 39/088; D06F 2105/04; D06F 39/12; D06F 34/22; D06F 2202/08; D06F 23/04; D06F 2103/12; D06F 34/24
See application file for complete search history.

(56) References Cited

U.S. PATENT DOCUMENTS 6,880,191 B2 4/2005 Bristor
8,277,733 B2 10/2012 McSherry et al.
10,533,276 B2 * 1/2020 Dunn ..... B05B 12/002
2007/0067920 A1 * 3/2007 Zaccone ..... D06F 39/088 8/158
2009/0148342 A1 6/2009 Bromberg et al.
2015/0190538 A1 7/2015 Olivera et al.
2016/0102425 A1 4/2016 Scheckelhoff
2016/0138207 A1 5/2016 Del Pos et al.
2016/0326685 A1 * 11/2016 Pollett ..... D06F 39/088
2019/0040568 A1 * 2/2019 Dunn ..... D06F 39/022
2019/0071815 A1 * 3/2019 Woodham, Jr. ..... D06F 37/10
(Continued)

FOREIGN PATENT DOCUMENTS

CN 105025861 A 11/2015
FR 2688996 A1 10/1993
(Continued)

*Primary Examiner* — Benjamin L Osterhout
(74) *Attorney, Agent, or Firm* — Dority & Manning, P.A.

(57) ABSTRACT

A washing machine appliance and nozzle assembly is provided herein. The washing machine appliance may include a cabinet, a tub positioned within the cabinet, a wash basket, and a nozzle assembly. The nozzle assembly may be mounted within the cabinet and configured to provide wash fluid to the tub. The nozzle assembly may include an extendable nozzle, a supply line, and a nozzle valve. The extendable nozzle may be movable between retracted and extended positions. The extendable nozzle may define a fluid path extending in fluid communication between a nozzle inlet and a nozzle outlet. The supply line may extend to the extendable nozzle in fluid communication therewith to provide a flow of wash fluid to the extendable nozzle. The nozzle valve may be positioned within the extendable nozzle in fluid communication with the supply line upstream from the nozzle outlet.

20 Claims, 11 Drawing Sheets

(56) References Cited

U.S. PATENT DOCUMENTS

| | | | | |
|---|---|---|---|---|
| 2019/0145042 | A1* | 5/2019 | Bensel | G08C 17/00 68/12.19 |
| 2019/0242052 | A1* | 8/2019 | Bensel | D06F 39/088 |
| 2019/0257022 | A1* | 8/2019 | Leibman | D06F 39/083 |
| 2019/0257023 | A1* | 8/2019 | Pollett | D06F 39/085 |

FOREIGN PATENT DOCUMENTS

| | | | |
|---|---|---|---|
| GB | 2495788 | A | 4/2013 |
| JP | 2007503877 | A | 3/2007 |

* cited by examiner

WASHING MACHINE APPLIANCE AND NOZZLE ASSEMBLY

FIELD OF THE INVENTION

The present subject matter relates generally to washing machine appliances and more particularly to nozzle assemblies for washing machine appliances.

BACKGROUND OF THE INVENTION

Washing machine appliances generally include a tub for containing water or wash fluid (e.g., water or water and detergent, bleach, or other wash additives). A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

During operation of certain washing machine appliances, a volume of water or wash fluid is directed into the tub in order to wash or rinse articles within the wash chamber. More specifically, a predetermined volume of water or wash fluid is typically provided through a stationary nozzle positioned at the center of the back wall of the washing machine appliance. However, in certain situations, a user may wish to have greater control over the water or wash fluid dispensed into the tub. For instance, a user may wish to direct the flow of water or wash fluid onto a particular garment or within a specific region of the wash tub (e.g., to perform a pretreating operation, to saturate a particular article of clothing, etc.). However, this ability may be limited by the increased complexity and wiring required to relocate existing stationary nozzles. Moreover, difficulties may arise with providing water at a desired temperature. The ability to adjust the amount of water or wash fluid and its dispensing location is a commercially desirable feature and increases the user's positive perception of the wash process generally.

Accordingly, a washing machine appliance that provides a user with more control over the dispensing of water or wash fluid is desirable. In particular, a nozzle assembly that enables the dispensing of an additional amount of water or wash fluid at a desired location and at a desired temperature within the tub would be particularly beneficial.

BRIEF DESCRIPTION OF THE INVENTION

Aspects and advantages of the invention will be set forth in part in the following description, or may be obvious from the description, or may be learned through practice of the invention.

In exemplary aspects of the present disclosure, a washing machine appliance is provided. The washing machine appliance may include a cabinet, a tub positioned within the cabinet, a wash basket, and a nozzle assembly. The wash basket may be rotatably mounted within the tub. The wash basket may define a wash chamber for receiving articles for washing. The nozzle assembly may be mounted within the cabinet and configured to provide wash fluid to the tub. The nozzle assembly may include an extendable nozzle, a supply line, and a nozzle valve. The extendable nozzle may be movable between a retracted position and an extended position. The extendable nozzle may define a fluid path extending in fluid communication between a nozzle inlet and a nozzle outlet. The supply line may extend to the extendable nozzle in fluid communication therewith to provide a flow of wash fluid to the extendable nozzle. The nozzle valve may be positioned within the extendable nozzle in fluid communication with the supply line upstream from the nozzle outlet to selectively restrict the wash fluid to the nozzle outlet.

In other exemplary aspects of the present disclosure, a washing machine appliance is provided. The washing machine appliance may include a cabinet, a tub positioned within the cabinet, a wash basket, and a nozzle assembly. The nozzle assembly may be mounted within the cabinet and configured to provide wash fluid to the tub. The nozzle assembly may include an extendable nozzle, a hot fluid line, a cold fluid line, a nozzle valve, and a user input. The extendable nozzle may be movable between a retracted position and an extended position. The extendable nozzle may define a fluid path extending in fluid communication between a nozzle inlet and a nozzle outlet. The hot fluid line may extend to the extendable nozzle in fluid communication therewith to provide a flow of hot fluid to the extendable nozzle. The cold fluid line may extend to the extendable nozzle in fluid communication therewith to provide a flow of cold fluid to the extendable nozzle. The nozzle valve may be positioned within the extendable nozzle along the fluid path upstream from the nozzle outlet to selectively restrict fluid to the nozzle outlet. The user input may be positioned on the extendable nozzle operably coupled to the nozzle valve to selectively direct the fluid from the nozzle outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
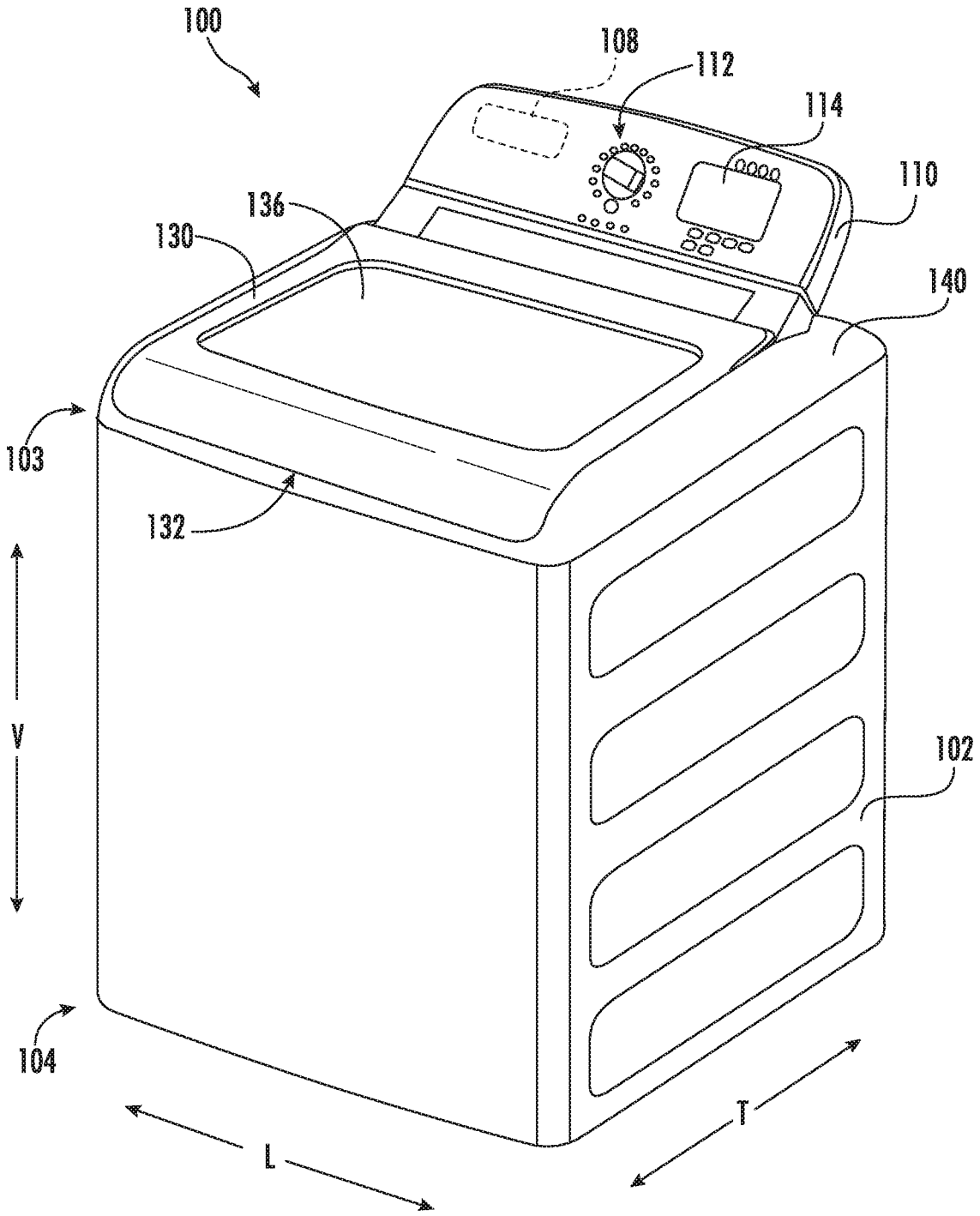
FIG. 1 provides a perspective view of a washing machine appliance according to an exemplary embodiment of the present disclosure with a door of the exemplary washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
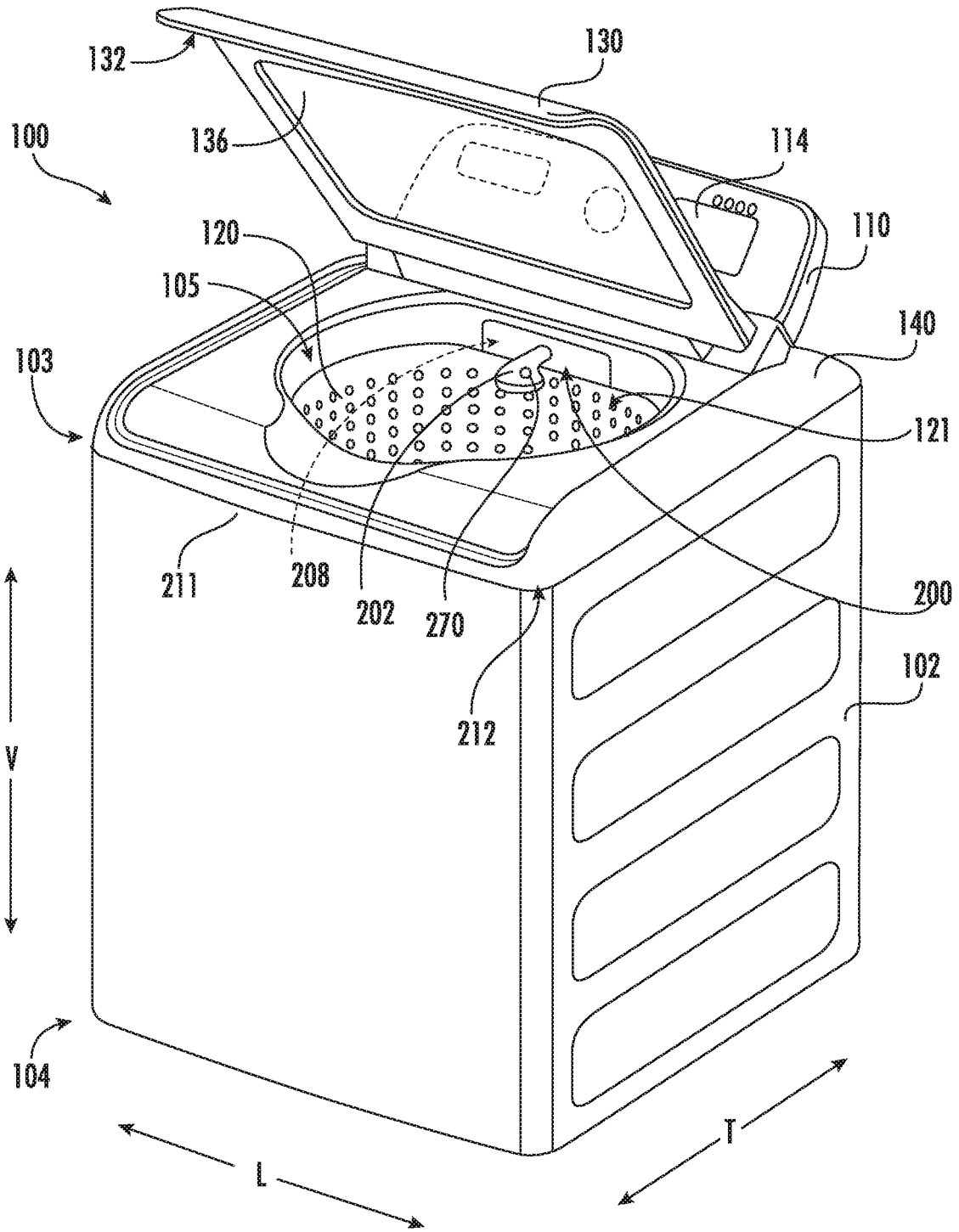
FIG. 2 provides a perspective view of the exemplary washing machine appliance of FIG. 1 with the door of the exemplary washing machine appliance shown in an open position.

Turning now to the figures, FIGS. 1 and 2 illustrate an exemplary washing machine appliance 100. In particular appliance 100 is shown as a vertical axis washing machine. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, using the teachings disclosed herein it will be understood that washing machine appliance 100 is provided by way of example only. Other washing machine appliances having different configurations, different appearances, or different features may also be utilized with the present subject matter as well (e.g., horizontal axis washing machines). Moreover, aspects of the present subject matter may be used in any other consumer or commercial appliance where it is desirable to control the dispensing of water or another fluid.

As shown, washing machine appliance 100 has a cabinet 102 that extends between a top portion 103 and a bottom portion 104 along the vertical direction V. A wash basket 120 is rotatably mounted within cabinet 102. A motor (not shown) is in mechanical communication with wash basket 120 to selectively rotate wash basket 120 (e.g., during an agitation cycle or a rinse cycle of washing machine appliance 100). Wash basket 120 is received within a wash tub or wash chamber 121 and is configured for receipt of articles for washing. The wash tub 121 holds wash and rinse fluids for agitation in wash basket 120 within wash tub 121. An agitator or impeller (not shown) may extend into wash basket 120 while remaining in mechanical communication with the motor. The impeller generally assists agitation of articles disposed within wash basket 120 and may rotate or oscillate during operation of washing machine appliance 100.

Cabinet 102 of washing machine appliance 100 generally includes a top panel 140. Top panel 140 defines an opening 105 (FIG. 2) that permits user access to wash basket 120 of wash tub 121. In some embodiments, door 130 is rotatably mounted to top panel 140 and permits selective access to opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In some embodiments, a window 136 in door 130 permits viewing of wash basket 120 when door 130 is in the closed position (e.g., during operation of washing machine appliance 100). Door 130 may also include a handle 132 that, for example, a user may pull or lift when opening and closing door 130. Further, although door 130 is illustrated as mounted to top panel 140, alternatively, door 130 may be mounted to another portion of cabinet 102, as well as any other suitable support.

In certain embodiments, a control panel 110 with at least one input selector 112 extends from top panel 140. Control panel 110 and input selector 112 collectively form a user interface input for operator selection of machine cycles and features. A display (e.g., electronic indicator display 114) of control panel 110 indicates selected features, operation mode, a countdown timer, or other items of interest to appliance users regarding operation.

Operation of washing machine appliance 100 is generally controlled by a controller or processing device 108 that is attached to cabinet 102 (e.g., at control panel 110) and operatively coupled (e.g., electrically coupled via one or more conductive signal lines, wirelessly coupled via one or more wireless communications bands, etc.) to portions of control panel 110 for user manipulation to select washing machine cycles and features. In response to user manipulation of control panel 110, controller 108 receives one or more signals (e.g., user-input signals) and operates the various components of washing machine appliance 100 to execute selected machine cycles and features.

Controller 108 may include a memory (e.g., non-transitive storage media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 108 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

During operation of washing machine appliance 100, laundry items are generally loaded into wash basket 120 through opening 105, and a washing operation or wash cycle is initiated through operator manipulation of input selectors 112. Wash basket 120 is filled with a fluid, such as water, detergent, other fluid additives (e.g., via a nozzle assembly 200 or a separate suitable fill spout). It is noted that nozzle assembly 200 may be the primary or sole fluid dispenser to tub 121 (e.g., for dispensing wash fluid as part of one or more wash cycles of washing machine appliance 100) or, alternatively, one of multiple fluid dispensers (e.g., a secondary dispenser that is operable to dispense wash fluid independent of a wash cycle of washing machine appliance 100). Moreover, one or more valves can be controlled by washing machine appliance 100 to provide for filling wash basket 120 to the appropriate level for the amount of articles being washed or rinsed. By way of example, for a wash cycle, once wash basket 120 is properly filled with fluid, the contents of wash basket 120 can be agitated (e.g., with an impeller as discussed above) for washing laundry items in wash basket 120.

After agitation (e.g., an agitation phase of the wash cycle) is completed, wash basket 120 can be drained. Laundry articles can then be rinsed by again adding fluid to wash basket 120 depending on the specifics of the wash cycle selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After laundry items or articles disposed in wash basket 120 are cleaned or washed, the user can remove the articles from wash basket 120 (e.g., by reaching into wash basket 120 through opening 105).

Referring now generally to FIGS. 2 through 7, nozzle assembly 200 will be described in more detail according to various exemplary embodiments of the present disclosure. Although the discussion below refers to nozzle assembly 200, one skilled in the art will appreciate that the features and configurations described may be used for other fluid supply assemblies in other washing machine appliances as well. For example, nozzle assembly 200 may be positioned in another location within cabinet 102, may have a different fluid supply conduit configuration, or may dispense any suitable wash fluid or fluids (e.g., water, detergent, other additives, or mixtures thereof). Other variations and modifications of the exemplary embodiments described below are possible, and such variations are contemplated as within the scope of the present disclosure.

As illustrated, nozzle assembly 200 generally includes an extendable nozzle 202 mounted to a retractable fluid supply conduit 204. More specifically, retractable fluid supply conduit 204 provides fluid communication between extendable nozzle 202 and a primary fluid line 207 (e.g., primary water line for hot water or cold water) so that a user may selectively dispense the wash fluid within wash tub 121. In some such embodiments, retractable fluid supply conduit 204 is movable for positioning extendable nozzle 202 in a retracted position and an extended position, as described in greater detail below.

In certain embodiments, primary fluid line 207 extends into cabinet 102 from an area or region outside of cabinet 102. Retractable supply conduit 204 may fluidly connect to primary fluid line 207 (e.g., directly or through and intermediate external conduit 225) at a multi-path joint 227 disposed outside of cabinet 102. Optionally, a mainline conduit 229 may extend from multi-path joint 227 in fluid parallel to retractable supply conduit 204. As shown, mainline conduit 229 may extend into cabinet 102 and connect to an internal valve assembly 206 (e.g., for controlling a fill spout to dispense water or wash fluid within wash tub 121). Although primary fluid line 207 is illustrated as a single flow path, it is understood that two or more discrete parallel flow paths may be provided. For instance, primary fluid line 207 may include a primary hot water line and a primary cold water line that is fluidly isolated from the primary hot water line. In turn, retractable fluid water supply conduit 204, multi-path joint 227, intermediate external conduit 225, or mainline conduit 229 may include multiple discrete lines or flow paths to keep water from the primary hot water line in the primary cold water line separate (e.g., until the water is dispensed into wash tub 121 or otherwise required to be mixed).

Internal valve assembly 206 may include a plurality of valves configured to supply, for example, hot water, cold water, warm water, a mixture of water and detergent, other wash additives, etc. According to exemplary embodiments, controller 108 is configured for controlling internal valve assembly 206 such that the valves therein that can be turned on/off independently or together in any combination. The valves of internal valve assembly 206 may be, for example, solenoid valves that are electrically connected to controller 108. However, any other suitable water valve may be used to control the flow of water or wash fluid. Controller 108 may selectively open and close internal valve assembly 206 to allow water or wash fluid to flow from hot water inlet, cold water inlet, detergent inlet, softener inlet, or any other suitable fluid through a respective valve seat. As would be understood, internal valve assembly 206 may further include a one or more detergent storage compartments, mixing chambers, or other features within which a fluid additive (e.g., powdered or liquid detergent) can mix with hot or cold water prior to being dispensed into wash tub 121.

Nozzle assembly 200 and its various components may be stored or mounted within cabinet 102 of washing machine appliance 100. In some embodiments, nozzle assembly 200 is mounted directly under top panel 140 along the vertical direction V such that nozzle assembly 200 is positioned between wash tub 121 and top panel 140. In this regard, washing machine appliance 100 may include a nozzle housing 208 defining a receiving chamber 209 within which fluid supply conduit 204 or extendable nozzle 202 are at least partially positioned. For example, when extendable nozzle 202 is in the retracted position, extendable nozzle 202 may be positioned within receiving chamber 209. In some such embodiments, extendable nozzle 202 remains visible to the user in the retracted position. However, when extendable nozzle 202 is pulled out toward the extended position, extendable nozzle 202 and at least a portion of fluid supply conduit 204 are positioned outside the receiving chamber 209 of nozzle housing 208 (e.g., above wash tub 121 along the vertical direction V). Notably, maintaining the position of extendable nozzle 202 above the wash tub 121 may ensure that water or wash fluid from within the wash tub 121 is not drawn back through extendable nozzle 202 (e.g., into the water supply or leaked elsewhere within washing machine appliance 100).

Although the positioning and movement of nozzle assembly 200 is described herein according to exemplary embodiments, it should be appreciated that variations and modifications to the operation of nozzle assembly 200 may be made while remaining within the scope of the present disclosure. For example, FIG. 2 illustrates nozzle housing 208 and extendable nozzle 202 as being positioned along a back wall 210 and at a center of cabinet 102 along the transverse direction T. By contrast, according to the exemplary embodiments of FIGS. 6 and 7, nozzle housing 208 and extendable nozzle 202 are illustrated as being positioned along a front wall 211 of cabinet 102 at a corner 212 or lateral side along the lateral direction L. However, either embodiment may be positioned at any other suitable location or locations within washing machine appliance 100.

Figure 3:
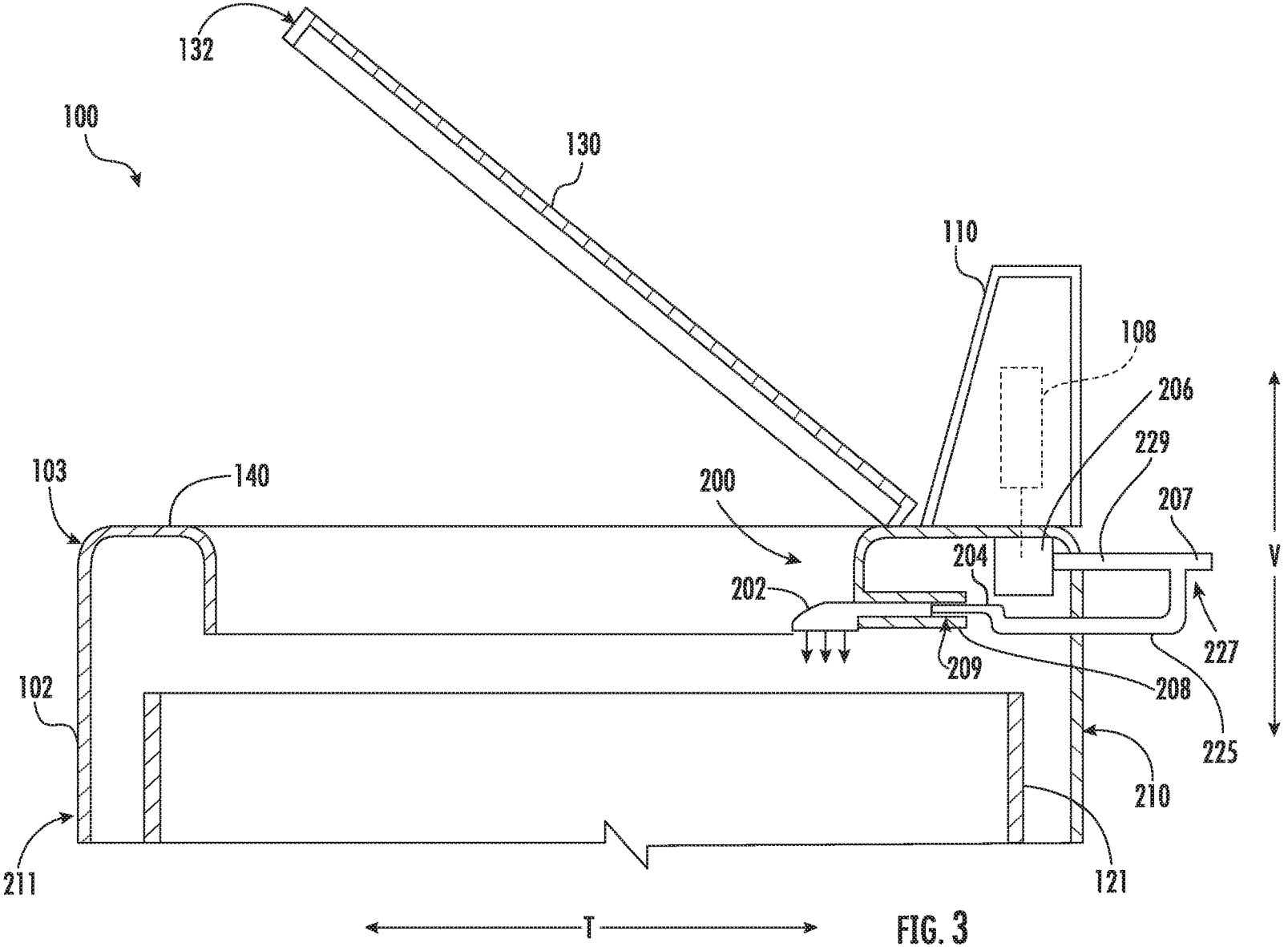
FIG. 3 provides a schematic side, cross-sectional view of a nozzle assembly of the exemplary washing machine appliance of FIG. 1 shown in a retracted position according to an exemplary embodiment of the present disclosure.
Figure 4:
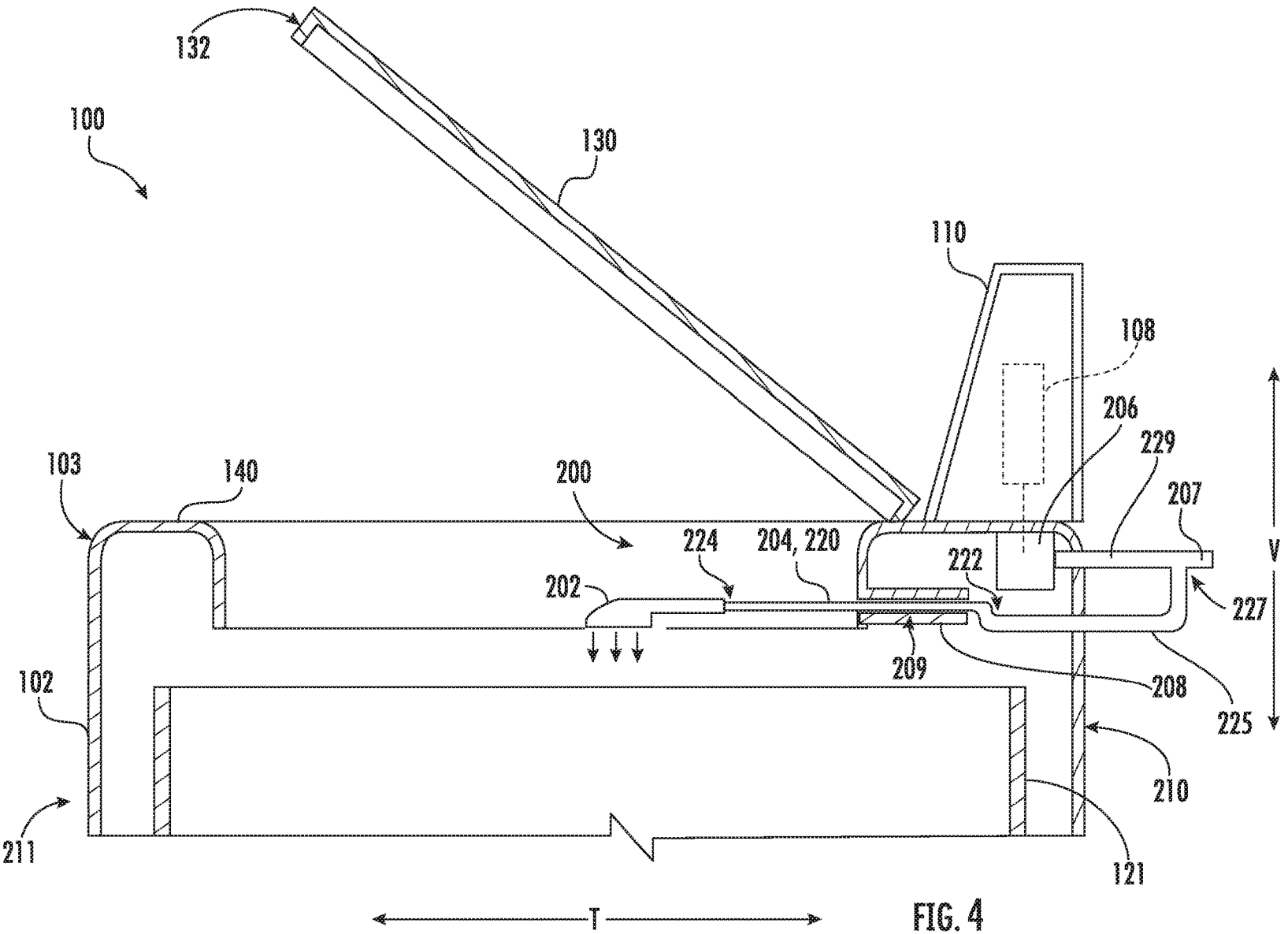
FIG. 4 provides a schematic side, cross-sectional view of the exemplary nozzle assembly of FIG. 3 shown in an extended position.
Figure 5:
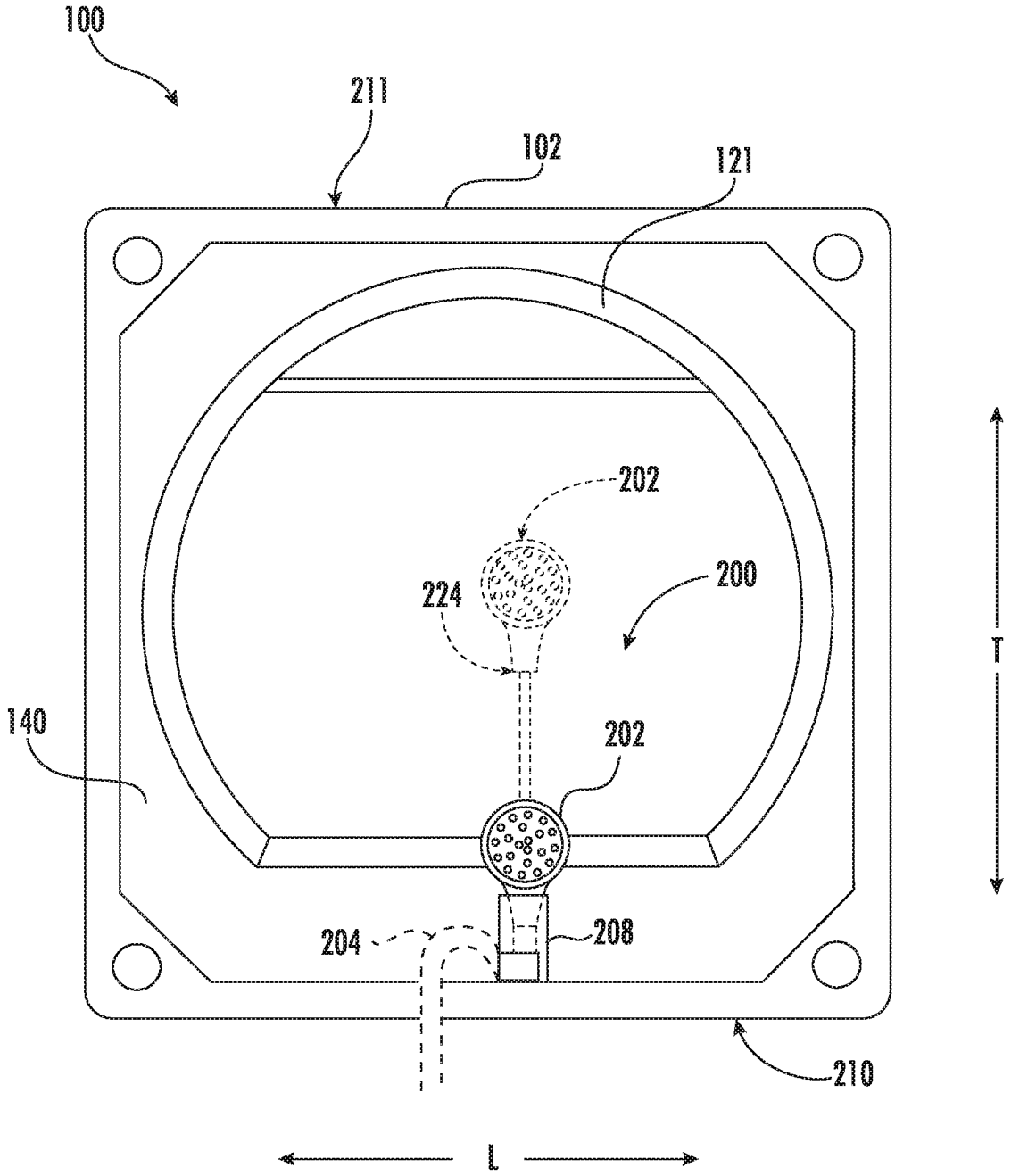
FIG. 5 provides a schematic view of the exemplary nozzle assembly of FIG. 3 shown in both the extended position (in phantom) and the retracted position.

Referring now specifically to FIGS. 3 through 5, retractable fluid supply conduit 204 includes a flexible hose 220 having a first end 222 fluidly connected or coupled to primary fluid line 207 (e.g., directly or through an intermediate external conduit 225 extending from cabinet 102 to primary fluid line 207) and a second end 224 fluidly connected or coupled to extendable nozzle 202. Flexible hose 220 may be any size sufficient to provide water or wash fluid at the desired flow rate and may be any length suitable for providing a user with flexibility in directing water or wash fluid to desired portions of wash tub 121 (or otherwise performing a pretreating operation for articles in or near wash tub 121). For example, flexible hose 220 may extend along the entire depth of washing machine appliance 100 along the transverse direction T. Alternatively, according to the illustrated embodiments, flexible hose 220 may only extend about half way into wash tub 121 within a vertical plane when in the extended position (see FIGS. 4 and 5). In this manner, the likelihood of extendable nozzle 202 spraying water or wash fluid outside of wash tub 121 is reduced. Optionally, one or more retraction mechanisms (not pictured), such as a weighted loop on (e.g., directly or indirectly on) flexible tube or a mechanical spring that extends from nozzle housing 208 to extendable nozzle 202, may be provided to urge or bias extendable nozzle 202 toward the retracted position (see FIG. 3).

Figure 6:
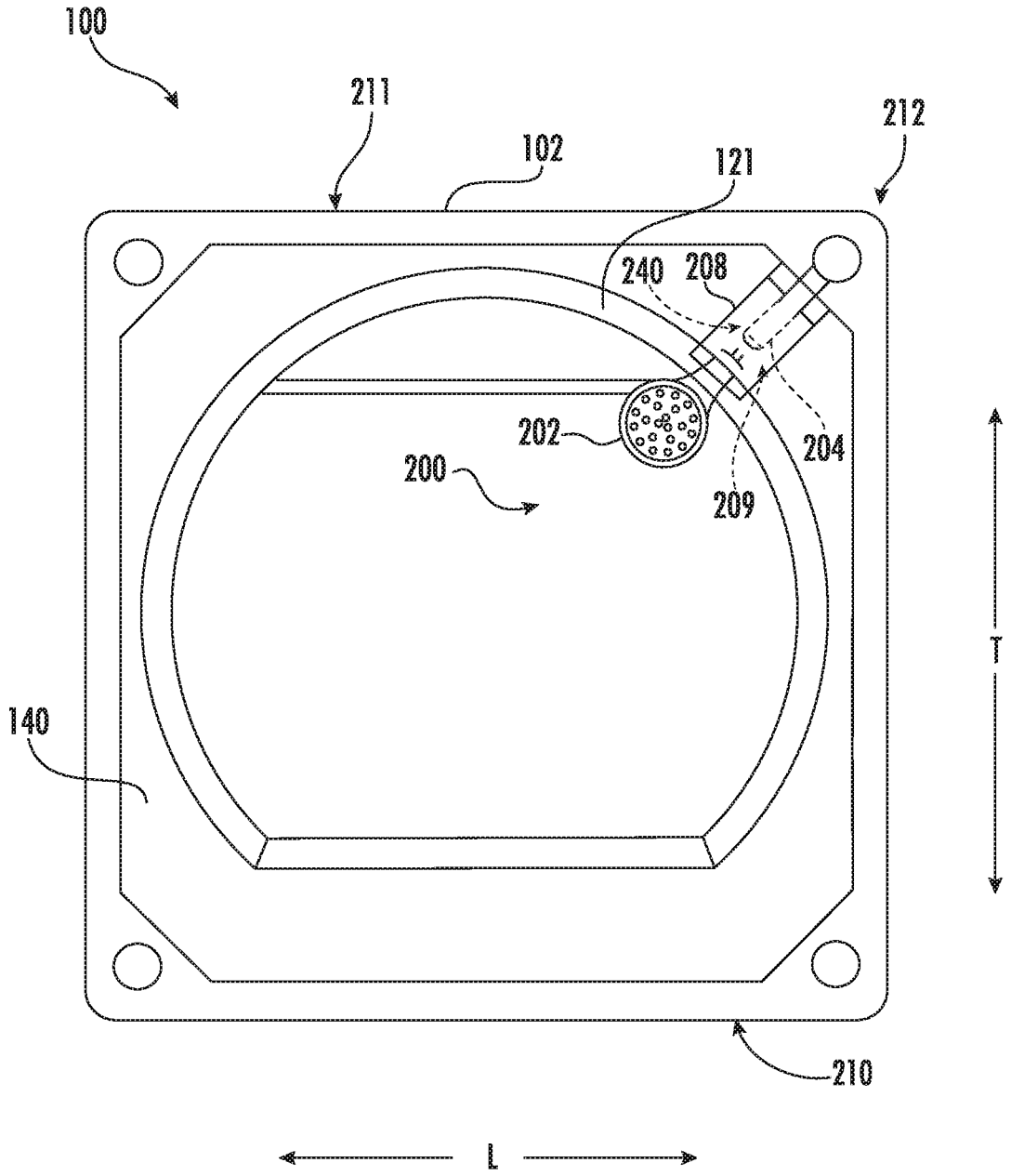
FIG. 6 provides a schematic view of a nozzle assembly of the exemplary washing machine appliance of FIG. 1 shown in a retracted position according to another exemplary embodiment of the present disclosure.
Figure 7:
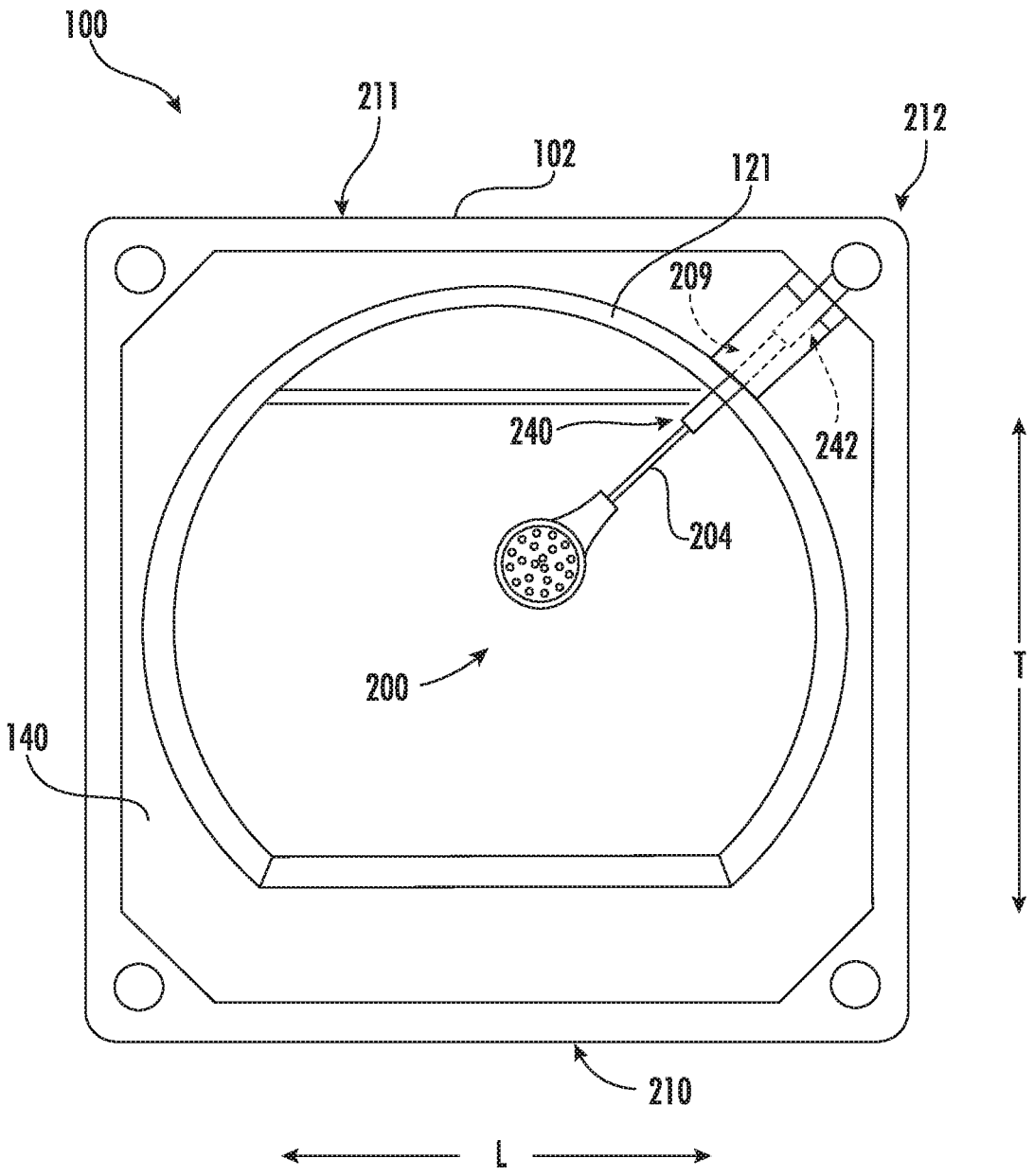
FIG. 7 provides a schematic view of the exemplary nozzle assembly of FIG. 6 shown in an extended position.

Referring now to FIGS. 6 and 7, according to one or more alternative embodiments, retractable fluid supply conduit 204 is a telescoping arm 240. As illustrated, telescoping arm 240 includes two or more telescoping sections 242 that are concentric to each other and may slide relative to each other as extendable nozzle 202 is moved between the extended position (see FIG. 7) and the retracted position (see FIG. 6). According to the illustrated embodiment, telescoping sections 242 of telescoping arm 240 actually function as the fluid conduit for providing a flow of wash fluid to extendable nozzle 202. However, it should be appreciated that according to alternative embodiments, a flexible tube or conduit may be positioned within and supported by telescoping arm 240.

In some embodiments, telescoping sections 242 engage each other such that telescoping arm 240 and extendable nozzle 202 extends only in a single vertical plane above wash tub 121. In this manner, the risk of dropping extendable nozzle 202 into wash tub 121 may be reduced or eliminated. In addition, a user may move extendable nozzle 202 to the extended position and then be free to use two hands underneath extendable nozzle 202 (e.g., to, scrub, work, or otherwise clean an article of clothing).

According to the illustrated embodiments of FIGS. 6 and 7, telescoping arm 240 includes three sections 242 and extends from a corner 212 of cabinet 102. In this manner, more space is provided to accommodate telescoping arm 240 and nozzle assembly 200 between wash tub 121 and cabinet 102. It should be appreciated that the size, position, number, and size of sections 242, and general configuration of telescoping arm 240 may vary according to alternative embodiments. For example, telescoping arm 240 could extend from the back center of cabinet 102. Alternatively, retractable fluid supply conduit 204 could be a fixed length arm that is connected in back corner 212 of cabinet 102 and pivots (e.g., pivots 45 degrees between a first position where extendable nozzle 202 is positioned at a back center of cabinet 102 to a second position where extendable nozzle 202 is positioned over a center of wash tub 121) within a vertical plane. Moreover, other configurations are possible and within the scope of the present disclosure.

Turning now to FIGS. 8 through 11, several schematic side, cross-sectional views of extendable nozzle 202 are shown, according to exemplary embodiments. As shown, extendable nozzle 202 defines a vertical direction V', which is understood to be parallel to corresponding vertical direction V (FIGS. 1 through 4), for example, when extendable nozzle 202 is in the retracted position. Although FIGS. 8 through 11 illustrate features of multiple embodiments, it is understood that, except as otherwise indicated, none of the exemplary embodiments of FIGS. 8 through 11 are understood to be mutually-exclusive. In other words, various features of one or more embodiments may be incorporated into one or more other embodiments, as would be generally understood. For instance, one or more features illustrated in one figure may be provided in the embodiment illustrated in another figure.

As shown in FIGS. 8 through 11, extendable nozzle 202 includes a nozzle body 310 defining a nozzle inlet 312 and a nozzle outlet 314. Nozzle inlet 312 is generally connected to (e.g., in fluid communication with) fluid supply conduit 204. Nozzle outlet 314 may include one or more spray ports or apertures and provides an output or exhaust for wash fluid from extendable nozzle 202. Within extendable nozzle 202 (e.g., within nozzle body 310), a fluid path 316 is defined between nozzle inlet 312 and nozzle outlet 314. For instance, one or more conduits or defined channels may be provided within extendable nozzle 202 to direct the flow of water or wash fluid. Thus, water or wash fluid entering extendable nozzle 202 at nozzle inlet 312 may generally flow along fluid path 316 before exiting extendable nozzle 202 (e.g., into the tub 121—FIG. 2) at nozzle outlet 314. Optionally, one or more agitation elements 318 (e.g., brushes, ridges, dimples, etc.) may be positioned on or extend from extendable nozzle 202 adjacent to nozzle outlet 314. For instance, agitation elements 318 may be positioned at a bottom portion of extendable nozzle 202 or surround at least a portion nozzle outlet 314 such that extendable nozzle 202 may be used to scrub or agitate articles as water or wash fluid is sprayed on those same articles.

In some embodiments, multiple discrete inlets 312A, 312B are defined within extendable nozzle 202. For instance, a discrete hot inlet 312A and cold inlet 312B may be provided in fluid parallel to each other. Corresponding inlet paths 320 may extend within extendable nozzle 202 from each of the hot inlet 312A and cold inlet 312B. In some such embodiments, fluid conduit 204 includes two discrete parallel fluid lines, such as a hot water line 205A and a cold water line 205B. Hot and cold water lines 205A, 205B may be connected to discrete primary supply conduits 207, as discussed above with respect to FIGS. 3 and 4. Moreover, as shown, hot water line 205A may be in fluid communication with hot inlet 312A (e.g., to direct relatively hot water to extendable nozzle 202 through hot water line 205A), while cold water line 205B is in fluid communication with cold inlet 312B. Optionally, retractable supply conduit 204 may include a joined conduit body 203 that encloses at least a portion of hot water line 205A and cold water line 205B (e.g., to avoid tangling or kinking of the discrete water lines 205A, 205B).

During certain conditions, it may be desirable to selectively adjust the fluid being dispensed from extendable nozzle 202. For instance, a user may wish to provide relatively hot water, cold water, or a mixture thereof from extendable nozzle 202. Generally, one or more nozzle valves 322 may be positioned within the extendable nozzle 202 in fluid communication with the supply line(s) 205A, 205B and nozzle inlets 312A, 312B upstream from the nozzle outlet 314 (e.g., to selectively restrict the water or wash fluid to the nozzle outlet 314). Optionally, the unified outlet path 324 may be defined in fluid communication between nozzle valve 322 and nozzle outlet 314. Unified outlet path 324 may be in selective fluid communication with each inlet path 320 (e.g., downstream therefrom) such that water or wash fluid from either inlet path 320 may be flowed to nozzle outlet 314 through unified outlet path 324.

Nozzle valve 322 may be any suitable mechanically or electromechanically actuated valve, such as a gate valve, mixing valve, solenoid, etc., for selectively controlling the flow of water or wash fluid through fluid path 316 (e.g., to nozzle outlet 314). Additionally or alternatively, nozzle valve 322 may be provided as a direct current (DC) valve, which is selectively actuated or positioned based on one or more DC signals directed thereto.

During use, a user may wish to add additional water to wash tub 121 or add a particular wash fluid for a pretreat operation. For example, a user may wish to prewash one or more articles of clothing or may perceive that more water or wash fluid is needed to effectively wash a load. In order to provide a user with control over the flow of water or wash fluid being dispensed through extendable nozzle 202, nozzle assembly 200 may include one or more user input buttons 270 for adding a wash fluid to wash tub 121. In other words, input buttons 270 may selectively direct water or wash fluid from the nozzle outlet 314. User input buttons 270 may be operably coupled with nozzle valve 322 (e.g., directly or, alternatively, indirectly through controller 108) for controlling the flow of water or wash fluid (e.g., whether hot water, cold water, or a mixture thereof is dispensed from extendable nozzle 202). In exemplary embodiments, user input button 270 is located on extendable nozzle 202 for easy access by an operator.

User input button 270 may be any button or switch suitable for providing an indication to onboard controller 330 or controller 108 that a particular action should be initiated. For example, input buttons 270 may be push button switches, toggle switches, rocker switches, or any other suitable tactile switch, such as capacitive touch buttons. In optional embodiments, input buttons 270 are momentary switches (sometimes referred to as mom-off-mom switches). In this regard, input buttons 270 may be biased switches that return to their unlatched or unpressed state when released (e.g., by spring force).

It should be appreciated that the amount of water or wash fluid added to wash tub 121 upon pressing input buttons 270 may vary depending on the application or wash cycle. Similarly, the amount of water or wash fluid delivered may be preset such that pressing input buttons 270 delivers the predetermined amount of water or wash fluid. Alternatively, valves 272 may be configured to remain open at all times when corresponding input buttons 270 are depressed. In this manner, a user may precisely control the amount of water added to wash tub 121. Further inputs may be provided for selecting certain conditions (e.g., temperature) of water or wash fluid from extendable nozzle 202. Advantageously, a user may be able to directly control the amount and condition (e.g., temperature) of wash fluid dispensed from extendable nozzle 202. Embodiments including one or more valves 322 may be notably more responsive to user inputs and instructions than other configurations wherein no valve is provided within extendable nozzle 202.

In certain embodiments, an onboard controller 330 is mounted within extendable nozzle 202. Onboard controller 330 may include a memory (e.g., non-transitive storage media) and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, onboard controller 330 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Onboard controller 330 may be operably coupled to user input buttons 270 or nozzle valve 322. Moreover, onboard controller 330 may be configured to selectively actuate or position nozzle valve 322 in response to one or more predetermined input signals (e.g., received from input buttons 270 or controller 108—FIG. 1). Optionally, onboard controller 330 or nozzle valve 322 may be electrically coupled to a power source or other portion of washing machine appliance 100 to receive an electrical current therefrom. For instance a conductive line or wire may extend through the joined conduit body 203. Additionally or alternatively, onboard controller 330 may include a power converter configured to transform a received alternating current into a transmittable direct current.

Advantageously, nozzle valve 322 may be actuated or controlled independently of the rest of washing machine appliance 100 (FIG. 1), such that the flow of water or wash fluid from extendable nozzle 202 is not contingent upon the flow of water or wash fluid to other portions of washing machine appliance 100.

Figure 8:
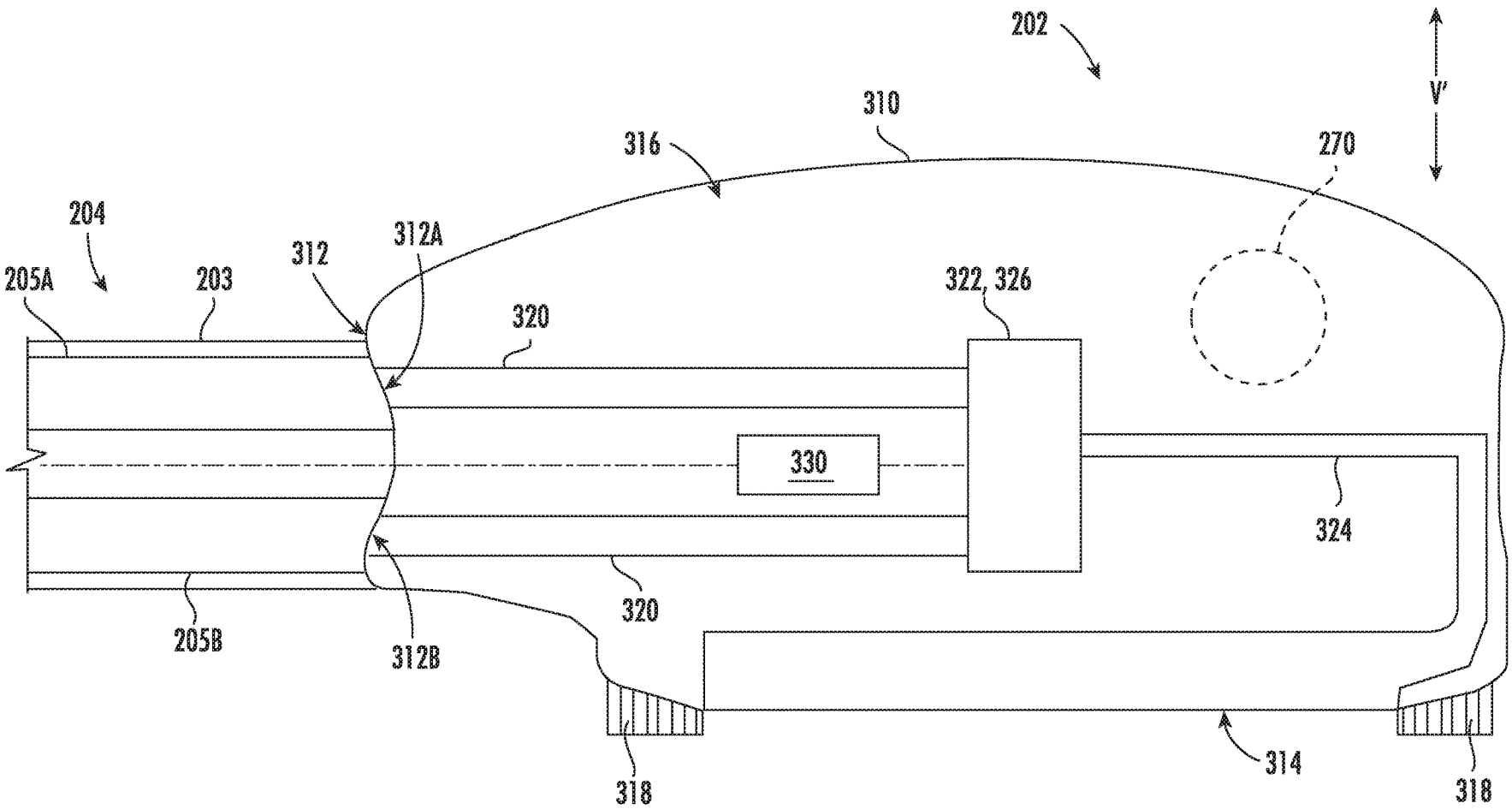
FIG. 8 provides a schematic side, cross-sectional view of an extendable nozzle according to exemplary embodiments of the present disclosure.

Turning especially to FIG. 8, exemplary embodiments of extendable nozzle 202 include nozzle valve 322 as a mixing valve 326. As shown, the mixing valve 326 may be positioned within extendable nozzle 202 in fluid communication with both hot water line 205A and cold water line 205B. For instance, mixing valve 326 may be positioned between the inlet paths 320 and the unified outlet path 324. During use, hot and cold water may simultaneously flow to nozzle valve 322, which may then control whether hot or cold water and subsequently flowed to and through nozzle outlet 314. Moreover, mixing valve 326 may selectively mix water or wash fluid from both lines 205A, 205B and, for example, control the ratio of hot water and cold water dispensed from extendable nozzle 202.

Figure 9:
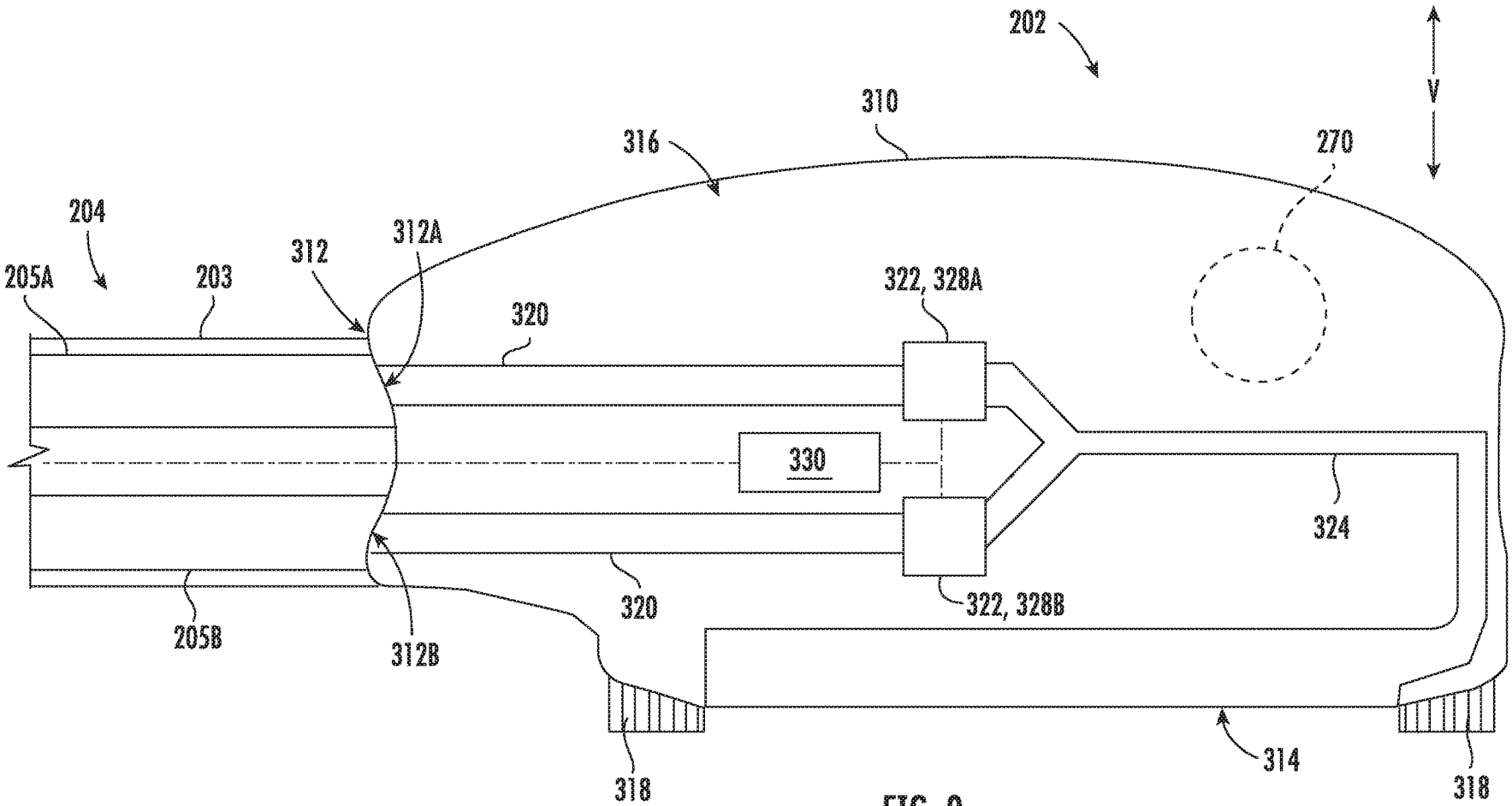
FIG. 9 provides a schematic side, cross-sectional view of an extendable nozzle according to exemplary embodiments of the present disclosure.

Turning especially to FIG. 9, exemplary embodiments of extendable nozzle 202 include nozzle valve 322 as multiple discrete valves 328A, 328B positioned within extendable nozzle 202. In particular, nozzle valve 322 may include a hot valve 328A and a cold valve 328B in fluid parallel with the hot valve 328A. For instance, the hot valve 328A may be positioned along one inlet path 320 that is downstream from hot water line 205A and hot inlet 312A, while cold valve 328B is positioned along another inlet path 320 that is downstream from cold water line 205B and cold inlet 312B. A joint branch may be provided downstream from both hot valve 328A and cold valve 328B (e.g., to join the inlet paths 320 upstream from the unified outlet path 324). During use, hot water may flow to hot valve 328A while cold water flows to cold valve 328B. Both hot valve 328A and cold valve 328B may then control or otherwise determine whether to permit water to flow to and through nozzle outlet 314. Moreover, hot valve 328A and cold valve 328B may be controlled in tandem to selectively mix water or wash fluid from both lines and, for example, control the ratio of hot water and cold water dispensed from extendable nozzle 202.

Figure 10:
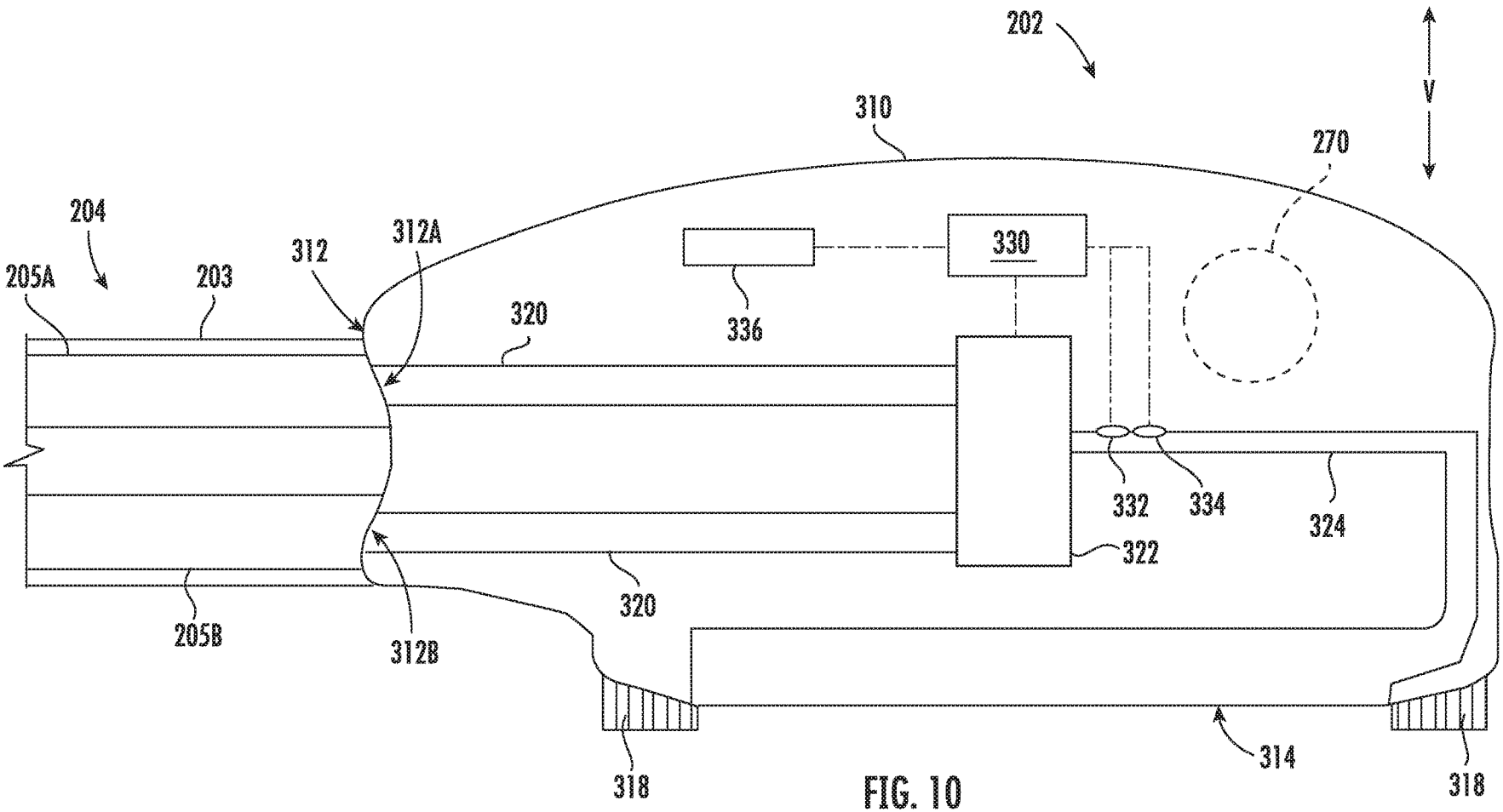
FIG. 10 provides a schematic side, cross-sectional view of an extendable nozzle according to exemplary embodiments of the present disclosure.

Turning especially to FIG. 10, exemplary embodiments of extendable nozzle 202 include one or more temperature sensors 332. A temperature sensor 332 may be provided as any suitable temperature-detecting element (e.g., thermistor, thermocouple, etc.). Moreover, temperature sensor 332 may be in operable coupled (e.g., electrically connected) onboard controller 330 or controller 108 (FIG. 1). For instance, a temperature sensor 332 may be positioned within extendable nozzle 202 upstream from the nozzle outlet 314. Optionally, temperature sensor 332 may be positioned downstream from nozzle valve 322 (e.g., along unified outlet path 324). Thus, temperature sensor 332 may detect the temperature of water or wash fluid within extendable nozzle 202 before it is dispensed from nozzle outlet 314. Moreover, signals relating to the detected temperature may be communicated with onboard controller 330 or controller 108.

Additional or alternative exemplary embodiments of extendable nozzle 202 include one or more fluid flow sensors 334. A fluid flow sensor 334 may be provided as any suitable element for detecting the flow of fluid therepast (e.g., mechanical flow meter, optical flow meter, pressure-based flow meter, etc.). Moreover, fluid flow sensor 334 may be in operable coupled (e.g., electrically connected) onboard controller 330 or controller 108 (FIG. 1). For instance, a fluid flow sensor 334 may be positioned within extendable nozzle 202 upstream from the nozzle outlet 314. Optionally, fluid flow sensor 334 may be positioned downstream from nozzle valve 322 (e.g., along unified outlet path 324). Thus, fluid flow sensor 334 may detect the flow rate (e.g., volumetric flow rate) of water or wash fluid within extendable nozzle 202 before it is dispensed from nozzle outlet 314. Moreover, signals relating to the detected flow rate may be communicated with onboard controller 330 or controller 108.

In optional embodiments, onboard controller 330 or controller 108 is configured to automatically (e.g., without further user prompts or direction) adjust or position nozzle valve 322 to maintain a desired wash fluid temperature based on one or both of the temperature or flow rate determined at sensors 332, 334.

In further additional or alternative embodiments of extendable nozzle 202 include a nozzle battery 336 is mounted to extendable nozzle 202 (e.g., enclosed therein) in order to power a portion of extendable nozzle 202 (e.g., by providing a direct electrical current from nozzle battery 336). For instance, nozzle battery 336 may be electrically coupled to onboard controller 330 or nozzle valve 322 and power operation thereof. Generally, nozzle battery 336 is provided as a direct current power source and, in specific embodiments, is a rechargeable battery formed of, for instance, lithium-ion, nickel-cadmium (NiCd), nickel-metal hydride (NiMH), etc. In some such embodiments, a battery charger (not pictured) is provided (e.g., within housing 208 or within extendable nozzle 202) to selectively recharge nozzle battery 336 when operably coupled therewith.

Figure 11:
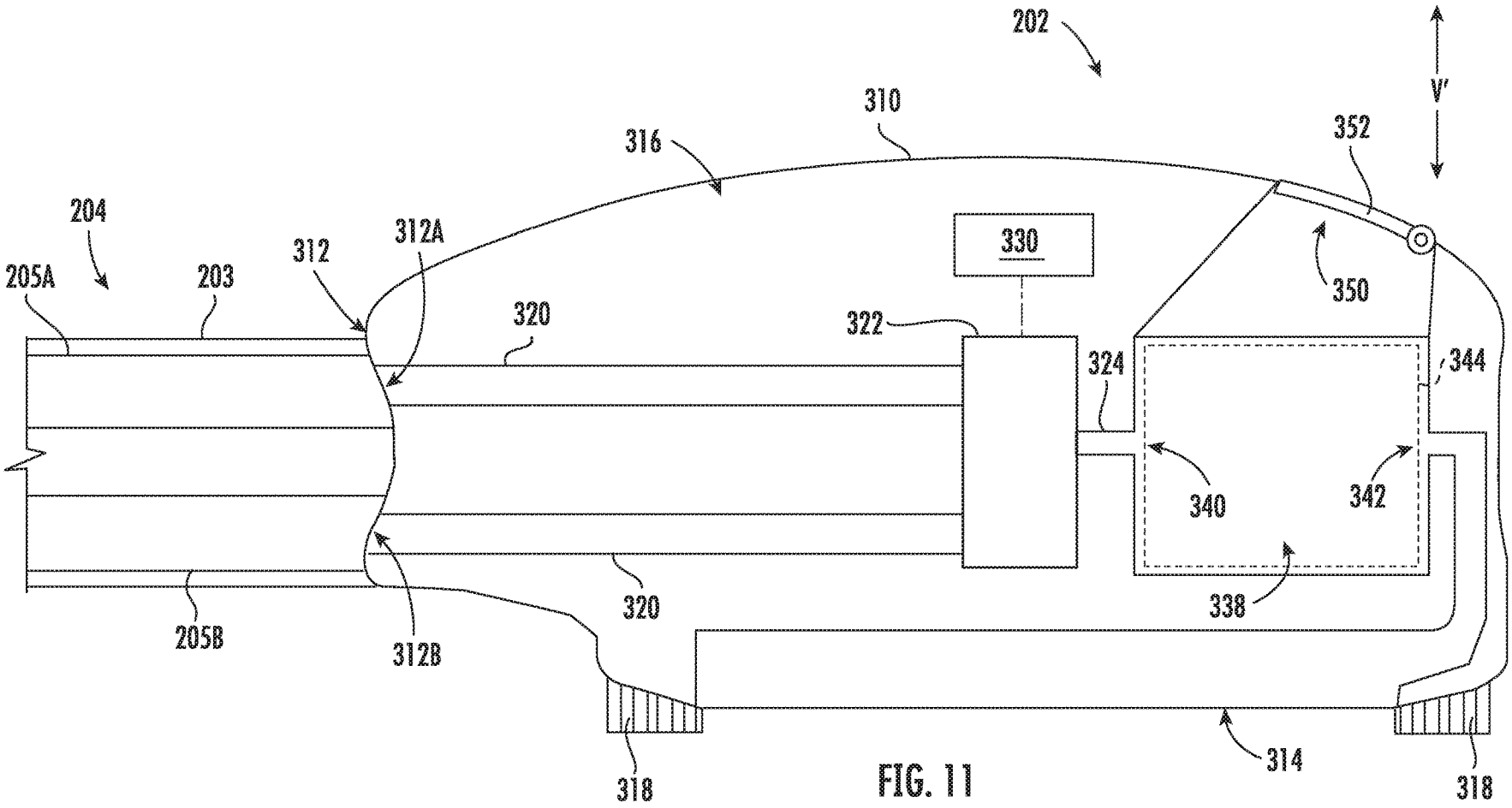
FIG. 11 provides a schematic side, cross-sectional view of an extendable nozzle according to exemplary embodiments of the present disclosure.

Turning especially to FIG. 11, exemplary embodiments of extendable nozzle 202 define an additive cavity 338. During certain conditions, it may be desirable to provide one or more additives to water or wash fluid being output from extendable nozzle 202. Additive cavity 338 may be formed to hold a wash additive (e.g., granular or fluid additives, such as detergent, bleach, fabric softener, etc.) to be added or mixed with water or wash fluid in extendable nozzle 202. Specifically, additive cavity 338 is defined in fluid communication with fluid path 316 at a location downstream from nozzle inlets 312A, 312B. For instance, one or more additives may be selectively supplied to fluid path 316 from additive cavity 338. Within extendable nozzle 202, additives may thus mix with the water or wash fluid from nozzle inlets 312A, 312B, before being expelled as a modified wash fluid from nozzle outlet 314.

In certain embodiments, additive cavity 338 at a position in line with fluid path 316. In particular, additive cavity 338 includes a discrete cavity entrance 340 and a discrete cavity exit 342 that are positioned in fluid series along fluid path 316. Thus, wash fluid may flow from nozzle inlets 312A, 312B or nozzle valve 322 and through cavity entrance 340 before the wash fluid is received within a defined volume of additive cavity 338. As shown, the defined volume of additive cavity 338 may define an enlarged diameter that is, optionally, greater than a maximum diameter of the fluid path 316 (e.g., a maximum diameter between nozzle inlets 312A, 312B and cavity entrance 340 or between cavity exit 342 and nozzle outlet 314). Within additive cavity 338, the received water or wash fluid may mix with wash additive before passing through cavity exit 342 and to nozzle outlet 314. Optionally, wash additive may be provided as or within a self-contained pod 344 that can be selectively added to or removed from additive cavity 338.

Nozzle body 310 may define an additive opening 350 in selective communication with additive cavity 338. As shown, additive opening 350 may be in parallel (e.g., fluid parallel) with nozzle inlets 312A, 312B. Thus, wash additive may be supplied to additive cavity 338 through additive opening 350. Extendable nozzle 202 may include a biased door 352 that selectively covers additive opening 350. For instance, biased door 352 may be mounted to nozzle body 310 (e.g., above additive cavity 338) and biased toward a sealed position (illustrated in FIG. 11) wherein additive opening 350 is covered and wash additive is prevented from flowing through additive opening 350. An outside force, such as one provided by a user, may move biased door 352 to an unsealed position where additive opening 350 is not covered and wash additive may be flowed through additive opening 350. Thus wash additive may be provided to additive cavity 338 when biased door 352 is in the unsealed position.

Optionally, biased door 352 may include a biasing spring mounted to a solid rotating member (e.g., flap). Additionally or alternatively, biased door 352 may be formed, at least in part, from an elastic biasing polymer. Moreover, any other suitable biasing member may be provided to selectively permit wash additive to flow to additive cavity 338 through additive opening 350 before returning biased door 352 to the sealed position.

Alternative embodiments may include any other suitable door or cover for selectively restricting and permitting access to additive cavity 338 through additive opening 350.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

cabinet;

a tub positioned within the cabinet;

a wash basket rotatably mounted within the tub, the wash basket defining a wash chamber for receiving articles for washing; and a nozzle assembly mounted within the cabinet and configured to provide wash fluid to the tub, the nozzle assembly comprising an extendable nozzle movable between a retracted position and an extended position, the extendable nozzle defining a fluid path extending in fluid communication between a nozzle inlet and a nozzle outlet, a supply line extending to the extendable nozzle in fluid communication therewith to provide a flow of wash fluid to the extendable nozzle, and a nozzle valve positioned within the extendable nozzle in fluid communication with the supply line upstream from the nozzle outlet to selectively restrict the wash fluid to the nozzle outlet.

2. The washing machine appliance of claim 1, further comprising a user input positioned on the extendable nozzle operably coupled to the nozzle valve to selectively direct the wash fluid from the nozzle outlet.

3. The washing machine appliance of claim 1, further comprising a controller attached to the cabinet and operably coupled to the nozzle assembly.

4. The washing machine appliance of claim 1, wherein the nozzle inlet comprises a hot inlet and a cold inlet, and wherein the supply line comprises a hot fluid line connected in fluid communication to the hot inlet and a cold fluid line connected in fluid communication to the cold inlet.

5. The washing machine appliance of claim 4, wherein the nozzle valve is a mixing valve in fluid communication with the hot fluid line and the cold fluid line to selectively mix wash fluid from the hot and cold fluid lines upstream from the nozzle outlet.

6. The washing machine appliance of claim 4, wherein the nozzle valve is a hot valve in fluid communication with the hot fluid line upstream from the nozzle out, wherein the nozzle assembly further comprises a cold valve in fluid communication with the cold fluid line upstream from the nozzle outlet, and wherein cold valve is positioned in fluid parallel to the hot valve.

7. The washing machine appliance of claim 1, further comprising a temperature sensor positioned within the extendable nozzle upstream from the nozzle outlet.

8. The washing machine appliance of claim 1, further comprising a fluid flow sensor positioned within the extendable nozzle upstream from the nozzle outlet.

9. The washing machine appliance of claim 1, wherein the nozzle assembly further comprises a nozzle battery mounted to the extendable nozzle to provide a direct electrical current thereto.

10. The washing machine appliance of claim 1, wherein the extendable nozzle defines a fluid path extending in fluid communication between the nozzle inlet and the nozzle outlet, wherein the nozzle valve is positioned along the fluid path, and wherein the extendable nozzle further defines an additive cavity in fluid communication with the fluid path downstream from the nozzle inlet and an additive opening in selective fluid communication with the additive cavity in parallel to the nozzle inlet.

11. A washing machine appliance comprising:

a cabinet;

a tub positioned within the cabinet;

a wash basket rotatably mounted within the tub, the wash basket defining a wash chamber for receiving articles for washing; and a nozzle assembly mounted within the cabinet and configured to provide fluid to the tub, the nozzle assembly comprising an extendable nozzle movable between a retracted position and an extended position, the extendable nozzle defining a fluid path extending in fluid communication between a nozzle inlet and a nozzle outlet, a hot fluid line extending to the extendable nozzle in fluid communication therewith to provide a flow of hot fluid to the extendable nozzle, a cold fluid line extending to the extendable nozzle in fluid communication therewith to provide a flow of cold fluid to the extendable nozzle, a nozzle valve positioned within the extendable nozzle along the fluid path upstream from the nozzle outlet to selectively restrict fluid to the nozzle outlet, and a user input positioned on the extendable nozzle operably coupled to the nozzle valve to selectively direct the fluid from the nozzle outlet.

12. The washing machine appliance of claim 11, further comprising a controller mounted to the extendable nozzle, the controller being operably coupled to the nozzle valve and the user input to control fluid from the nozzle outlet.

13. The washing machine appliance of claim 11, further comprising a controller attached to the cabinet and operably coupled to the nozzle assembly.

14. The washing machine appliance of claim 11, wherein the nozzle valve is a mixing valve in fluid communication with the hot fluid line and the cold fluid line to selectively mix fluid from the hot and cold fluid lines upstream from the nozzle outlet.

15. The washing machine appliance of claim 11, wherein the nozzle valve is a hot valve in fluid communication with the hot fluid line upstream from the nozzle out, wherein the nozzle assembly further comprises a cold valve in fluid communication with the cold fluid line upstream from the nozzle outlet, and wherein cold valve is positioned in fluid parallel to the hot valve.

16. The washing machine appliance of claim 11, further comprising a temperature sensor positioned within the extendable nozzle upstream from the nozzle outlet.

17. The washing machine appliance of claim 11, further comprising a fluid flow sensor positioned within the extendable nozzle upstream from the nozzle outlet.

18. The washing machine appliance of claim 11, wherein the nozzle assembly further comprises a nozzle battery mounted to the extendable nozzle to provide a direct electrical current thereto.

19. The washing machine appliance of claim 11, wherein the extendable nozzle defines a fluid path extending in fluid communication between the nozzle inlet and the nozzle outlet, wherein the nozzle valve is positioned along the fluid path, and wherein the extendable nozzle further defines an additive cavity in fluid communication with the fluid path downstream from the nozzle inlet and an additive opening in selective fluid communication with the additive cavity in parallel to the nozzle inlet.

20. A washing machine appliance comprising:

a cabinet;

a tub positioned within the cabinet;

a wash basket rotatably mounted within the tub, the wash basket defining a wash chamber for receiving articles for washing; and a nozzle assembly mounted within the cabinet and configured to provide fluid to the tub, the nozzle assembly comprising an extendable nozzle movable between a retracted position and an extended position, the extendable nozzle defining a fluid path extending in fluid communication between a nozzle inlet and a nozzle outlet, a hot fluid line extending to the extendable nozzle in fluid communication therewith to provide a flow of hot fluid to the extendable nozzle, a cold fluid line extending to the extendable nozzle in fluid communication therewith to provide a flow of cold fluid to the extendable nozzle, a nozzle valve positioned within the extendable nozzle along the fluid path upstream from the nozzle outlet to selectively restrict fluid to the nozzle outlet, and a user input positioned on the extendable nozzle operably coupled to the nozzle valve to selectively direct the fluid from the nozzle outlet, a temperature sensor positioned within the extendable nozzle upstream from the nozzle outlet, and a controller mounted to the extendable nozzle, the controller being operably coupled to the nozzle valve, the user input, and the temperature sensor to control fluid from the nozzle outlet.

* * * * *